United States Patent [19]

Maschke

[11] Patent Number: 4,560,905

[45] Date of Patent: Dec. 24, 1985

[54] ELECTROSTATIC QUADRUPOLE FOCUSED PARTICLE ACCELERATING ASSEMBLY WITH LAMINAR FLOW BEAM

[75] Inventor: Alfred W. Maschke, East Moriches, N.Y.

[73] Assignee: The United States of America as represented by the United States Department of Energy, Washington, D.C.

[21] Appl. No.: 600,645

[22] Filed: Apr. 16, 1984

[51] Int. Cl.[4] ..... H01J 25/10

[52] U.S. Cl. ..... 315/5.41; 313/382; 313/439; 250/396 R; 315/5.34; 315/382

[58] Field of Search ..... 315/5.41, 31 R, 382; 313/382, 439; 250/396 R, 396 M

[56] References Cited

U.S. PATENT DOCUMENTS

| | | | |
|---|---|---|---|
| 2,919,381 | 12/1959 | Glaser | 250/396 R |
| 3,753,034 | 8/1973 | Spicer | 250/396 R |
| 3,831,121 | 8/1974 | Oster | 250/396 ML |
| 4,350,927 | 9/1982 | Maschke | 315/5.41 |
| 4,360,760 | 11/1982 | Brodowski | 315/5.41 |
| 4,392,080 | 7/1983 | Maschke | 315/5.41 |

OTHER PUBLICATIONS

"Space Charge Limits in ESQ Transport Systems" by Maschke et al., IEEE Trans. on Nuclear Sci., vol. NS-30, No. 4, Aug., pp. 2558-2559.

"Design & Operation of a Laminar Flow Electrostatic—" by Maschke et al., BML 51692, TIC-4500 Jul. 20/83 (3 pages).

"Space Charge Limits for Linear Accelerators" by A. W. Maschke BNL 51022, UC-28, TID 4500 May 1, 1975 (12 pages).

*Primary Examiner*—Harold Dixon

*Attorney, Agent, or Firm*—Vale P. Myles; Paul A. Gottlieb; Judson R. Hightower

[57] ABSTRACT

A charged particle accelerating assembly provided with a predetermined ratio of parametric structural characteristics and with related operating voltages applied to each of its linearly spaced focusing and accelerating quadrupoles, thereby to maintain a particle beam traversing the electrostatic fields of the quadrupoles in the assembly in an essentially laminar flow throughout the assembly.

7 Claims, 3 Drawing Figures

QUADRUPOLE ASSEMBLY MOUNTED ON OPTICAL BENCH

QUADRUPOLE ASSEMBLY
MOUNTED ON OPTICAL BENCH

ELECTROSTATIC QUADRUPOLE FOCUSED PARTICLE ACCELERATING ASSEMBLY WITH LAMINAR FLOW BEAM

The U.S. Government has rights in this invention pursuant to Contract Number DE-AC02-76CH00016, between the U.S. Department of Energy and Associated Universities Inc.

BACKGROUND OF THE INVENTION

This invention relates to a charged particle accelerating assembly that utilizes a plurality of linearly spaced electrostatic quadrupoles to focus and accelerate charged particles in a beam. More particularly, the invention relates to such an accelerating assembly that has structural and operating parameters which are effective to maintain essentially laminar flow of a beam of particles as it traverses the electrostatic fields of the quadrupoles in the assembly.

The basic operating principles and general structural features of charged particle accelerating assemblies or columns, such as those now commonly used in linear accelerators, or so-called Linacs, are well known to those familiar with high energy physics. Both magnetic and electrostatic quadrupole focusing in such accelerators has been successfully implemented. Electrostatic quadrupoles are particularly advantageous because they consume very little power and are inexpensive to construct, compared with magnetic quadrupoles. Reference may be made to U.S. Pat. Nos. 4,392,080, issued July 5, 1983 and 4,350,927, issued Sept. 21, 1982, for a fairly detailed discussion of electrostatic quadrupole design parameters. Along with a general background description of a method and apparatus for effecting quadrupole focusing, those patents disclose a method and apparatus for accelerating parallel beams of charged particles to produce a beam high intensity.

As is pointed out in those patents, it is usually desirable in the design and construction of a particle accelerating assembly to maximize the attainable beam "brightness", or 6-dimensional phase space density, of the particle beam being focused or accelerated. For the purpose of understanding the invention disclosed herein, the concept of "brightness" can be considered to be a parameter that increases with increasing beam current density and decreases with any tendency of the beam to diverge. One technique for improving beam brightness is to make the beam have laminar flow; thus, the desirability of designing and constructing particle beam acceleration columns to have essentially laminar beam flow is well known. However, a suitable means of attaining the desired objective of an essentially laminar flow beam was not heretofore clearly established.

In the design of early particle beam accelerator columns, the focusing characteristics were typically derived experimentally from columns already in existence, for which acceptable focusing conditions had been determined by trial and error. Because of this emperical approach, the focusing performance of a given accelerator assembly is not generally separable from the particular ion source or other particle injector used with the accelerator. Moreover, so long as the design of future accelerator columns is based primarily on extrapolation from imperically obtained data, a considerable degree of uncertainty will remain in the optimization attainable for the laminar flow of particle beams that are focused and accelerated in such columns.

The traditional way in which particle beams are accelerated in electrostatic devices is based on use of Pierce-type beam accelerating structures. Such assemblies operate well in a space charge limited condition, and will produce particle beams having temperatures that are comparable with those of their originating sources of particles. However, it has been recognized that the current density of a particle beam focused with a Pierce-type accelerator assembly or column is restricted by the Child-Langmuir relation. Thus, a disadvantage of the traditional Pierce-type of acceleration is that if the ion source itself is not the limiting constraint, then the achievable current density is limited by the electric field at which sparking occurs, according to the following equation:

$$J = 5.44 \times 10^{-8} \frac{E^2}{V^{\frac{1}{2}}} \cdot \frac{1}{A^{\frac{1}{2}}} \quad (1)$$

where J is current density in amperes/meter$^2$, E is the electric field in the accelerating column, V is the terminal voltage and A is the atomic weight of the singly charged ions. It is readily apparent from equation (1) that the achievable current density J decreases as the terminal voltage V is made higher. This limitation can be overcome or avoided, by using electrostatic quadrupole focusing to achieve particle beam acceleration.

In that regard, it can be shown that the space charge limited current density in a constant energy quadrupole transport channel is greater than the density (J) given by equation (1), if it is assumed that the electic fields on the respective quadrupoles is made as high as the electrostatic ion source extraction fields. In practice, that is a conservative assumption. Consequently, it follows that if a particle beam can be transported a large distance at the Child-Langmuir current density limit, the beam can be accelerated as it goes from one quadrupole to another. Hence, the need for having a high gradient acceleration column can be completely avoided.

SUMMARY OF THE INVENTION

A primary object of the present invention is to provide a charged particle accelerating assembly that utilizes electrostatic quadrupoles to maintain substantially laminar flow of a particle beam traversing the quadrupole fields within the assembly.

Another object of the invention is to provide a particle accelerating column that utilizes a plurality of substantially structurally identical, linearly spaced electrostatic quadrupoles to focus and accelerate a particle beam into an essentially laminar flow.

A further object of the invention is to provide a charged particle accelerating assembly having a plurality of structurally similar electrostatic quadrupoles on each of which a quadrupole voltage is applied that is substantially different than that applied on each of the other quadrupoles in the assembly, thereby to achieve laminar particle beam flow through the assembly.

Still another object of the invention is to provide a charged particle accelerating assembly having a plurality of linearly spaced quadrupoles that are designed to have their respective electrode lengths vary from one another, according to a predetermined inter-relationship that enables the assembly to accelerate a particle beam with laminar flow, responsive to each quadrupole voltage being made equal to that of the other quadrupole voltages in the assembly.

Further objects and advantages of the invention will become apparent to those skilled in the art from the description of it presented herein, considered in conjunction with the accompanying drawings.

DESCRIPTION OF THE PREFERRED EMBODIMENTS

The design and construction of a wide variety of different kinds of electrostatic quadrupoles is well known. Likewise, the general operating parameters of charged particle accelerating assemblies, or accelerating columns, is generally known. Accordingly, it is not necessary in providing an understanding of the present invention to discuss all of the details of manufacture and assembly of the most advanced types of particle acceleration columns with which the invention might be used. In order to simplify the description of the invention, it will be disclosed herein with reference to a relatively basic type of quadrupole assembly and associated mounting and positioning means that are effective to arrange and operate a plurality of such assemblies in the novel manners that are characteristic of the invention. From this description it will be apparent that the objects of the invention can be realized either by using a plurality of such separate quadrupole assemblies suitably arranged in linearly spaced relationship, or by mounting a plurality of more complex planar arrays of quadrupole assemblies in a similar linearly spaced relationship. It is a preferred mode of practicing the invention to use such planar arrays of quadrupoles, according to the teachings of the invention, to produce laminar flow particle beams of very high "brightness".

In order to incorporate herein all of the features of such an alternative form of the invention, i.e., one which uses such a plurality of planar arrays of quadrupole assemblies to form a particle beam acceleration column, my earlier U.S. Pat. Nos. 4,392,080, issued July 5, 1983, and 4,350,927, issued Sept. 21, 1982, are incorporated herein by reference. Attention is directed to the respective specification portions of those patents for their teachings of the details of design, construction and operation of suitable planar arrays of quadrupoles, and associated mounting and spacing means, for forming charged particle accelerating assemblies of a preferred type that can be readily modified, according to the principles disclosed herein, for making an accelerating assembly that provides essentially laminar flow for an exceptionally high density particle beam according to the present invention. The means for modifying or adapting the teachings of these patents, in order to use them in practicing the present invention, will be understood from the following description of the preferred embodiments of the invention, which are disclosed herein with respect to the simple prototype separate quadrupole assemblies shown in FIGS. 1–3.

Figure 1:
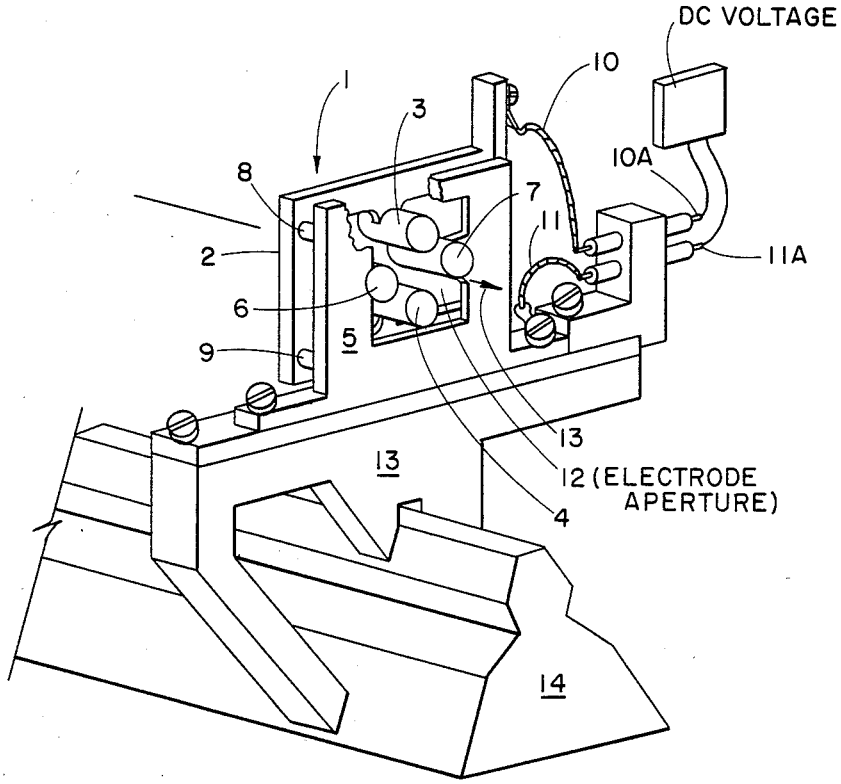
FIG. 1 is a perspective view of an electrostatic quadrupole assembly and a portion of a mounting table and positioning rail for moving the assembly relative to other quadrupoles (not shown). A voltage source and electric circuit means are shown connected for appropriately energizing the electrodes of the quadrupole. The quadrupole assembly is a prototype that has been proven to be usable, in conjunction with other similar quadrupole assemblies and associated mounting means, to form a charged particle accelerating assembly or column according to the present invention.

There is shown in FIG. 1 an electrostatic quadrupole 1 of a simplified design that was used, along with a plurality of other structurally similar separately mounted quadrupoles, for developing and testing the present invention. Suitable arrangements of such quadrupoles to form various embodiments of charged particle accelerating assemblies, according to the invention, will be explained below, with reference to FIGS. 2 and 3. First, though, the basic features of quadrupole 1 will be explained. Quadrupole 1 includes a first electrode-supporting plate 2 on which a pair of vertically oriented electrodes 3 and 4 are mounted in a conventional manner, such as by being bolted (bolts not shown) to the support plate 2. A second electrode-supporting plate 5 also has two electrodes 6 and 7 mounted on it in a similar manner, but oriented in a horizontal plane. The vertical electrodes 3 and 4, and horizontal electrodes 6, and 7 may be formed in a variety of different configurations, and may be made of different electrically conductive materials, as is well known. In the embodiment of the quadrupole 1 disclosed here, the electrodes are formed as solid cylinders of steel. In order to electrically isolate the support plates 2 and 5 from one another, a plurality of dielectric spacing blocks, such as the two blocks 8 and 9 shown in FIG. 1, are mounted between the plates in a suitable conventional manner, such as by being bolted or staked thereto. Electrically conductive circuit means, shown here in the form of cables 10 and 11, are operatively connected, respectively, to the plates 2 and 5 for energizing the electrodes 3, 4, and 6, 7 in a well-known manner. Cables 10 and 11 terminate, respectively in terminals 10A and 11A, which are adapted to be connected to a suitable source of DC voltage, shown schematically in FIG. 1.

The four electrodes of quadrupole 1 are disposed to define a particle beam-receiving aperture (designated 12). The aperture 12 is arranged, in the operation of the quadrupole as part of an accelerating column, to receive a beam of particles designated by the arrow 13, which is focused and accelerated by the electrostatic forces exerted on the particles in the beam by the electric fields produced between the electrodes of the quadrupole. It is well known by those skilled in the art that in order to use a plurality of quadrupoles, such as the quadrupole 1, to focus a particle beam 13, the quadrupoles must be arranged in linearly spaced relationship, with alternate quadrupoles having their respective vertically and horizontally oriented electrodes sequentially energized with opposite polarities with respect to the next adjacent quadrupole. Thus, if the particle beam 13 is made up of negatively charged particles, and assuming the vertically oriented electrodes 3 and 4 are negatively charged, while the horizontally oriented electrodes 6 and 7 are positively charged, the particle beam 13 will experience a strong net focusing effect from the vertical electrodes, while undergoing a de-focusing effect in the horizontal plane. Accordingly, in a charged particle accelerating assembly formed of a plurality of such linearly spaced quadrupoles, the next quadrupole in the succession would have its vertically oriented electrodes positively charged, while its horizontally oriented electrodes would be negatively charged, thereby to produce a net focusing effect on the particle beam 13 in a horizontal direction when it traverses the electrostatic field of that next succeeding quadrupole. Such fundamental principles of operation of electrostatic quadrupoles as they are often used in particle beam accelerating assemblies is well known, so will not be unduly elaborated here. In the event that additional detailed description of a charged particle accelerating column using quadrupole focusing is desired, reference may be made to one of my two earlier-identified patents, which describe in further detail such general principles of operation. Moreover, those patents makes it clear that a planar array of such quadrupoles can be used to focus and accelerate a plurality of parallel particle beams; thus, it will be apparent from the description of the invention herein that it can be used either with individual quadrupoles arranged in linearly spaced relationship, or with a plurality of planar arrays of quadrupoles such as those described in the just-referenced patents.

There is also illustrated in FIG. 1 a moveable table 13 that is arranged to slide horizontally on a rail 14 so that the position of the quadrupole 1 can be readily changed by moving it along the length of the rail 14. Any of a variety of suitable conventional table structures and associated positioning means can be used in affording these desired supporting and adjustment functions for the quadrupoles used in practicing the invention, as will be readily apparent to those skilled in the art.

The electrostatic quadrupole 1 can be readily altered in configuration by changing the size or shape of the electrodes 3, 4, and 6, 7 as will be explained more fully below. In practicing one preferred embodiment of the present invention, the lengths of the quadrupole electrodes are varied from one quadrupole to another in a certain specified manner in order to achieve essentially laminar flow of a particle beam 13 through the successive apertures of a linearly spaced plurality of such quadrupole assemblies. To provide suitable electrodes of variable lengths, it will be recognized that metal cylinders of different desired lengths can be substituted for the electrodes 3, 4 and 6, 7 in the depicted quadrupole 1. In the preferred embodiments described here, the spacing of the four electrodes from one another, within each quadrupole, is arranged so that the diameter of the particle beam-receiving aperture 12 is made approximately equal to the diameter of one of the electrodes. It will be recognized that alternative spacing arrangements of the quadrupole electrodes may be used in other forms of the invention. The significance of any such variation in electrode spacing, relative to its affect on the desired objective of the invention of providing laminar flow for a particle beam traversing a plurality of linearly spaced quadrupole, will be more fully discussed below.

Figure 2:
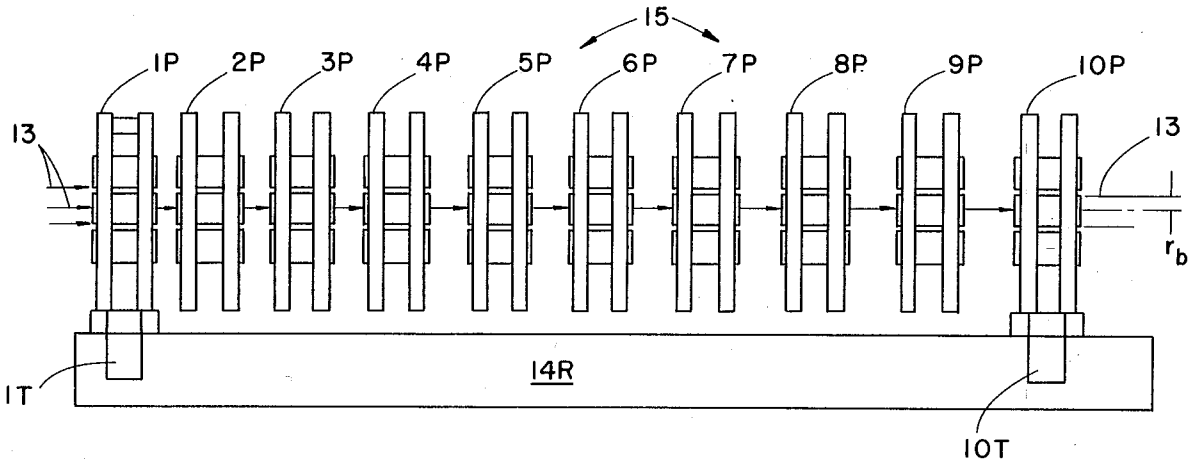
FIG. 2 is a schematic side plan view of a plurality of quadrupole assemblies, each of which has four substantially identical electrodes, and is otherwise generally similar to that shown in FIG. 1. The quadrupoles are mounted on a common positioning rail, like the rail partly shown in FIG. 1. Each quadrupole is suitably connected (by circuit means such as those shown in FIG. 1, but not shown in FIG. 2) to be, energized, respectively, at different voltage levels, according to a preferred form of the subject invention, thereby to maintain laminar flow of a particle beam accelerated through the successive quadrupoles of the assembly.

FIG. 2 illustrates a charged particle accelerating assembly that is constructed according to one preferred embodiment of the invention, using a plurality of individual electrostatic quadrupoles that are positioned in linearly spaced relationship to one another. Although ten quadrupoles are shown in FIG. 2, it should be understood that a plurality of any given number of quadrupoles may be used in alternative embodiments of the invention. The use of ten quadrupoles is discussed here, because experiments have been conducted with such an arrangement and the resulting data for such a ten quadrupole accelerating column is thus readily available for presentation herein to disclose such a proven form of the invention.

Although the quadrupoles 1P through 10P are depicted schematically in FIG. 2, it should be understood that each of them, in this embodiment of the invention, is made substantially identical to one another in structure and is constructed in the general configuration shown in FIG. 1. Similarly, although only two quadrupole supporting tables 1T and 10T are shown schematically, as being slidably mounted on the positioning rail 14R, those components have essentially the configurations shown for the table 13 and rail 14 illustrated in FIG. 1. The spacing between the respective quadrupoles 1P–10P can be readily adjusted by sliding them along rail 14R.

It should also be understood that the particle accelerating assembly, designated by the reference number 15 in FIG. 2, includes, in addition to the quadrupoles, tables and positioning rail, a suitable conventional vacuum tube (not shown) operatively disposed around the quadrupoles 1P–10P, conventional coupling devices for introducing a beam of charged particles 13 from an adjacent particle source (not shown), as well as suitable transport means for transmitting the particle beam 13 away from the accelerating assembly 15 toward some desired and target. Examples of such suitable conventional coupling devices and arrangements, particle sources, pre-accelerators, transport means etc., are disclosed more fully in my two above-noted U.S. patents. As pointed out above, the teachings of those patents are incorporated herein to provide a suitable disclosure of such associated mechanisms and operating parameters, for use in conjunction within the particle accelerating assembly 15 shown in FIG. 2, in making a first preferred embodiment of the invention.

A characteristic novel feature of the accelerating assembly 15 shown in FIG. 2, which enables it to operate according to the principles of the present invention to maintain the particle beam 13 in a desired laminar flow, is that each of the quadrupoles 1P–10P is made substantially identical in structure to one another; particularly, so far as their respective electrode lengths and effective radius of beam-focusing aperture is concerned. According to the invention, each of the quadrupoles 1P–10P is mounted in combination, respectively, with suitable electric circuit means and voltage source means (an example of which is shown in FIG. 1, but which is not shown in FIG. 2) for applying to each of the quadrupoles a voltage that is proportional to the energy of the beam 13 as it traverses the respective quadrupoles. Further, each of the quadrupoles is energized at a different voltage that is determined according to the requirements of equation (2), as explained more fully below.

This operating relationship, which is discussed below with reference to other critical quadrupole parameters, is effective to maintain laminar flow of the particle beam 13, in accordance with the invention. At this point, to facilitate understanding of the invention, it can be understood that one typical set of quadrupole voltages proven to work for successfully operating the assembly 15, in one of the tests performed on such an assembly, is given in the following Table I:

TABLE I

| Quad. Ass'y. No. | Quadrupole Volt. ($E_Q$) in KV Horizontal Electrodes | Vertical Electrodes |
|---|---|---|
| P1 | 2.94 | 2.75 |
| P2 | 2.60 | 2.80 |
| P3 | 2.64 | 2.44 |
| P4 | 2.25 | 2.46 |
| P5 | 2.25 | 2.03 |
| P6 | 1.78 | 2.01 |
| P7 | 1.73 | 1.50 |
| P8 | 1.17 | 1.42 |
| P9 | 1.05 | .798 |
| P10 | .363 | .629 |

Although not separately shown in FIG. 2, it will be understood that each of the quadrupoles 1P–10P is provided with suitable circuit means and an associated source of supply voltage, similar to the conductors 10 and 11 shown in FIG. 1, and the DC voltage source illustrated schematically therein as connected to the terminals 10A and 11A.

Figure 3:
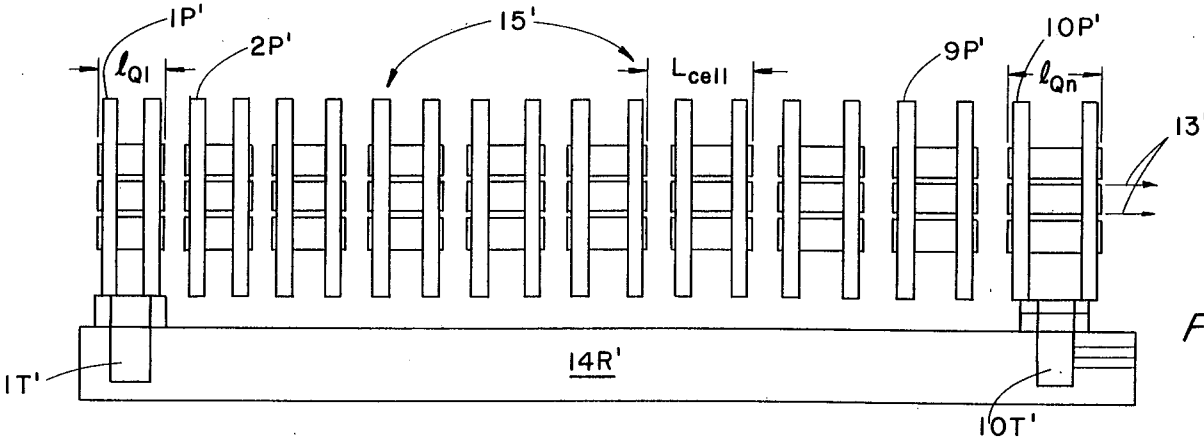
FIG. 3 is a schematic side plan view of a plurality of electrostatic quadrupole assemblies positioned on a common rail, such as the rail depicted in FIG. 1, to form a charged particle accelerating assembly in which each of the quadrupoles has sets of electrodes that differ in length from those in adjacent quadrupoles. Each of the quadrupoles is energized by suitable means (not shown) with substantially the same voltage, thereby to afford essentially laminar flow of the beam according to an alternative embodiment of the invention.

Before describing other modifications of the invention, such as the alternative embodiment of a charged particle accelerating assembly which is illustrated in FIG. 3, it will further understanding of the principles of the invention if the critical design parameters for establishing a desired laminar flow beam condition in a particle accelerating assembly of the invention is explained more fully now. The design of a laminar flow quadrupole-focused particle accelerating assembly, such as the assembly 15, can be broken down into two steps. First, means must be provided to match an associated particle or ion source with the first quadrupole (1P) of the accelerating assembly. In experimental work done with the charged particle accelerating assembly 15 shown in FIG. 2, a Low Energy Beam Transport system (LEBT) to accomplish that function was made up of 20 electrostatic quadrupoles arranged in linearly spaced relationship between the ion source and the first quadrupole 1P of assembly 15. Such LEBT systems are famililiar to those skilled in the art, but if additional description of their structure or function is desired, reference may be had to my above-designated two U.S. patents, which disclose the use of such an LEBT in conjunction with a Linac that utilizes a plurality of linearly spaced planar arrays of quadrupoles to focus parallel beams.

The particle beam (13) supplied by the LEBT to the initial quadrupole (1P) is analyzed at its exit from the LEBT to imperically determine when a space charge limited laminar flow condition has been achieved at that exit. This imperical determination provides the designer with the appropriate geometry and quadrupole voltage for the first quadrupole (1P) of the acceleration assembly or column (15), when the particle beam 13 has only the energy of the source extraction voltage.

The second step in the design of an accelerating assembly, such as assembly 15, according to the invention, is to change either the quadrupole structural parameters or the applied quadrupole voltages in relation to the increased beam energy as the particle beam traverses the successive quadrupoles (1P–10P) of the assembly (15). It can be shown that the space charge limited current in a quadrupole channel is proportional to $\mu_o^2 r_b^2 V^{3/2} L_{cell}^2$. That relationship must be maintained throughout the charged particle accelerating assembly (15) in order to achieve the desired laminar flow of a particle beam (13). Using the well known thin lens approximation gives, $\mu_o$ as proportional to $E_Q 1_Q \cdot L_{cell}/(r_Q V)$. Thus, the laminar flow condition for the beam (13) is given by the equation:

$$\frac{r_b^2 E_Q^2 l_Q^2}{r_Q^2 V_n^{\frac{1}{2}}} = \text{constant } (K) \qquad (2)$$

In equation (2), $r_b$ is the particle beam radius (in FIG. 2 the approximate boundries of $r_b$ are shown by the arrows near the right side of quadrupole 10P), $r_Q$ is the half-aperture dimension of the beam-receiving aperture (12 in FIG. 1) of the quadrupoles 1P–10P. (Thus, it can be seen that if the beam-receiving aperture 12 of the quadrupoles is made equal in diameter to the diameter of one of the quadrupole electrodes, $r_Q$ would equal the radius of one such electrode). $E_Q$ is the electric field of a quadrupole, $1_Q$ is the quadrupole length (i.e., the length of one of the electrodes, such as electrode 3 shown in FIG. 1, measured in a direction parallel to the particle beam 13), and $V_n$ is the energy in electron volts of the particle beam 13 at the level existing in the respective quadrupole (1P, 2P, or . . . nP) of design interest.

In addition to the foregoing two fundamental design steps, the only other constraint a designer should observe in practicing the invention is to make sure that the optical changes permitted from quadrupole to quadrupole are made gradually. It has been discovered from the experimental work done with the subject invention that this constraint translates into a requirement that the beam energy (V) not be changed by an unduly large amount in a single quadrupole gap. Specifically, for the charge particle accelerating assembly 15 shown in FIG. 2, the beam energy change was limited to 15% per quadrupole; more precisely, the beam energy (V) was allowed to increase by a factor of 4 as the beam traversed the fields of the 10 quadrupoles 1P–1P shown in the assembly 15 of FIG. 2.

Using the foregoing design parameters and constraints, a charged particle accelerating assembly can be constructed according to the principles of the invention so it will maintain laminar flow of a particle beam traversing the assembly, i.e., provided the respective quadrupoles of the assembly are made to conform to the parametric requirements of equation 2. Thus, in effecting such construction to make a charged particle accelerating assembly, such as assembly 15, each of the quadrupoles 1P–10P is made to have an effective beam-receiving radius $r_Q$, an electrode length $1_{Qn}$, and an applied voltage $E_{Qn}$ (where the subscript n refers to the respective number of the quadrupole). Then the quadrupoles are arranged in linearly spaced relationship, as shown in FIG. 2, to operate in combination with a particle beam 13 (from a suitable source, not shown) having a beam energy $V_n$ and a beam radius $r_b$ at each of the respective quadrupoles, such that the parameters of the assembly maintain a constant ratio K that satisfies equation (2). As pointed out above, when those conditions were satisfied in constructing the assembly 15, it was then tested and found to maintain laminar flow of a particle beam (13) at all measured points along the length of the beam.

In the design of a charged particle accelerating column it is normally desirable to use a plurality of quadrupoles that are essentially identical to one another in structure, as is the case in the assembly 15 shown in FIG. 2. However, it will be seen from equation (2) above that a laminar beam flow condition can be achieved by varying either the length of the electrodes in the respective quadrupoles, or by varying the quadrupole voltage $E_Q$ that is applied to respective quadrupoles throughout the accelerating assembly. Moreover, it is usually assumed that the ratio between the quadrupole beam-receiving aperture $r_Q$ and the particle beam radius $r_b$ is to be maintained constant throughout a given accelerating column. It can be seen that such a condition is not necessary and it should be recognized that in practicing the present invention a designer may actually want all of the radii ($r_Q$) to taper, from one quadrupole (1P) through successive quadrupoles (2P–10P–nP), in an appropriate manner to provide a spherically focusing array. The basic relationship to be maintained in developing such modified charge particle assemblies according to the principles of the present invention is that $E_Q 1_Q$ be kept proportionate to $V^{1/4}$.

As was the case with the embodiment of the invention shown in FIG. 2, in the alternative embodiment of an acceleration column 15' shown in FIG. 3, the parameters of the column 15' are made such that the associated particle beam 13' has an output energy $V_{out}$ that equals 4 $V_{in}$. Accordingly, the energy $V_n$ at the successive quadrupoles increases by approximately 15% per quadrupole over the accelerating assembly 15'. Specifically, a voltage gain of 4 occurs in the 10 gaps of the quadrupoles 1P'–10P' shown in FIG. 3. The design of the parameters for initial beam-receiving quadrupole 1P' are also either determined from earlier work, such as that explained in my two above-referenced U.S. patents, or may be emperically derived from that earlier work. It was determined that $r_Q/L_{cell}$ approximates 0.106, and $\mu_o$ approximates 75°, such that $\mu_o$ is proportional $V^{-\frac{1}{2}}$, and $V_Q$ approximates 0.1 $V_{in}$. The length of the respective quadrupole electrodes $1_Q$ is made proportional to $V^{\frac{1}{4}}$. All of the quadrupoles 1P'–10P' of the assembly 15' are energized with a substantially equal gap voltage $E_Q$. A suitable voltage source and circuit means (such as those shown in FIG. 1) are connected to apply the electrostatic field voltages $E_{Qn}$ to each of the quadrupoles in the assembly 15', thereby to maintain laminar beam flow as it traverses the respective electrostatic fields of all of the quadrupoles in the assembly 15'. Each of the quadrupoles in the assembly 15' has a substantially identical effective radius of beam-receiving aperture ($r_Q$). Accordingly, it can be seen from equation (2) that the only significant parametric variable in the design and construction of the quadrupoles of the assembly 15' is in their respective electrode lengths $1_Q$. As noted, the electrostatic fields $E_Q$ are held substantially equal to one another for all the quadrupoles 1P'–10P' in this form of the invention.

The performances achieveable with the acceleration columns 15 and 15' of the preferred embodiments of the invention shown, respectively, in FIGS. 2 and 3, can be compared with the performance of an ideal Pierce-type acceleration column. For such a Pierce-type column, as noted at the outset, the Child-Langmuir law gives current density J in amperes/m$^2$. In addition to equation (1) above, such current density J can be determined by the formula:

$$J = 5.44 \times \frac{10^{-8}\, V^{3/2}}{A^{\frac{1}{2}} d^2} \tag{3}$$

where A is the atomic number of the ion being accelerated, and d is the length in meters of the acceleration column. For the accelerating column 15 shown in FIG. 2, in one of the initial tests performed with it, A equaled 40, V=4,000, d=0.25, and J was found to approximate 4.7 amps/m$^2$; thus, it was determined that the Pierce-type column limit was exceeded by a factor of over 100.

Furthermore, emittance measurements were made at the output end (near 10P) of the accelerating column 15 and did, indeed, confirm that the particle beam flow (13) was essentially laminar. Actually, the first experimental measurements showed that effective beam temperature (V) was approximatly 0.3 eV in the vertical plane and approximately 0.04 eV in the horizontal plane. However, after using an improved match in the LEBT that was coupled to the input end (near 1P) of the column 15, subsequent measures showed that a beam temperature of about 0.04 eV was produced in both the vertical and horizontal plane at the output end of accelerating assembly or column 15. Moreover, the current intensity remained essentially unchanged, or laminar, over the length of the beam 13.

Those skilled in the art will recognize that various further modifications and alternative embodiments of the invention can be made from the disclosure of it presented herein. Accordingly, it is my intention to encompass the true spirit and scope of the invention within the limits of the following claims.

I claim:

1. In a charged particle accelerating assembly having a plurality of electrostatic quadrupoles positioned in linearly spaced relationship to one another, with each of said quadrupoles having four electrodes that are operable to focus and accelerate charged particles into a beam that successively traverses the fields of each of the quadrupoles, the improvement comprising;

each of said quadrupoles having an effective beam-receiving aperture radius ($r_Q$), an electrode length ($1_Q$), an applied quadrupole voltage ($E_Q$), and each of said quadrupoles being operable in combination with a particle beam having an energy $V_n$, and a beam radius ($r_b$) at the respective quadrupoles, thereby to maintain a constant parametric ratio (K) that satisfies the equation:

$$\frac{r_b^2}{r_Q^2} \; \frac{E_Q^2 l_Q^2}{r_Q^2 V^{\frac{1}{2}}} = K$$

2. In a charged particle accelerating assembly having a plurality of electrostatic quadrupoles positioned in linearly spaced relationship to one another, with each of said quadrupoles having four electrodes that are operable to focus and accelerate charged particles into a beam that successively traverses the fields of each of the quadrupoles, the improvement comprising;

each of said quadrupoles being substantially identical to one another in electrode length and in effective radius of beam-receiving aperture, and each of said quadrupoles being operably mounted in combination with a particle beam having an energy $V_n$ at the respective quadrupoles and in combination with means for applying to the electrodes of each of said quadrupoles a field voltage ($E_Q$) that is proportional to ($V_n^{\frac{1}{4}}$) at the respective quadrupoles, thereby to maintain essentially laminar flow of said particle beam throughout its length as it traverses the fields of the quadrupoles in the accelerating assembly.

3. An invention as defined in claim 2 wherein each of said quadrupoles are substantially identical to one another in structural configuration.

4. An invention as defined in claim 3 wherein the change in beam energy is limited to 15% per quadrupole.

5. In a charged particle accelerating assembly having a plurality of electrostatic quadrupoles positioned in linearly spaced relationship to one another, with each of said quadrupoles having four electrodes that are operable to focus and accelerate charged particles into a beam that successively traverses the fields of each of said quadrupoles, the improvement comprising;

each quadrupole having an electrode length ($1_Q$) that is proportional to the beam energy ($Vn^{\frac{1}{4}}$) at the respective quadrupoles therein, in combination with means for applying to each of said quadrupoles a voltage ($E_Q$) that is substantially equal for each of the quadrupoles, thereby to maintain laminar flow of said beam of particles throughout the assembly.

6. An assembly as defined in claim 5 wherein the change in beam energy is limited to be less than approximately 15% per quadrupole.

7. An assembly as defined in claim 5 wherein each of said quadrupoles has an effective radius ($r_Q$) of beam-receiving aperture that is substantially identified to the similar radii ($r_Q$) of the other quadrupoles in the assembly.

* * * * *